US006324838B1

(12) United States Patent
Stempien et al.

(10) Patent No.: US 6,324,838 B1
(45) Date of Patent: Dec. 4, 2001

(54) FLOW DEFLECTOR MEMBER FOR EXHAUST MANIFOLD

(75) Inventors: Vincent Stempien, West Bloomfield; Paul Wesley Kenyon, Taylor; Thomas Ketelhut, Southgate, all of MI (US)

(73) Assignee: Metaldyne Tubular Products, Inc., Canton, MI (US)

( * ) Notice: Subject to any disclaimer, the term of this patent is extended or adjusted under 35 U.S.C. 154(b) by 0 days.

(21) Appl. No.: 09/414,396

(22) Filed: Oct. 7, 1999

(51) Int. Cl.[7] ..... F01N 7/10
(52) U.S. Cl. ..... 60/323; 60/324
(58) Field of Search ..... 60/323, 324, 307

(56) References Cited

U.S. PATENT DOCUMENTS

| | | | | |
|---|---|---|---|---|
| 2,911,066 | * | 11/1959 | Neely | 60/323 |
| 3,581,494 | * | 6/1971 | Scheitlin et al. | 60/323 |
| 3,635,031 | * | 1/1972 | Haddad | 60/307 |
| 3,775,979 | * | 12/1973 | Scheitlin et al. | 60/323 |
| 3,864,909 | * | 2/1975 | Kern | 60/323 |
| 4,280,588 | * | 7/1981 | Veldhuizen | 60/323 |
| 4,373,329 | * | 2/1983 | Martini | 60/323 |
| 4,420,933 | * | 12/1983 | Kajitani et al. | 60/323 |
| 4,850,189 | * | 7/1989 | Arthur et al. | 60/323 |
| 4,939,898 | * | 7/1990 | Ichimura et al. | 60/323 |
| 4,999,999 | * | 3/1991 | Takahashi et al. | 60/324 |
| 5,349,817 | * | 9/1994 | Bekkering | 60/323 |
| 5,484,575 | * | 1/1996 | Steenackers | 60/324 |
| 5,606,857 | * | 3/1997 | Harada | 60/323 |
| 6,082,103 | * | 7/2000 | Sugiura et al. | 60/323 |

FOREIGN PATENT DOCUMENTS 1474-303 A1 * 4/1989 (SU) .

* cited by examiner

*Primary Examiner*—Thomas Denion
*Assistant Examiner*—Tu M. Nguyen
(74) *Attorney, Agent, or Firm*—Edgar A. Zarins; Lloyd D. Doigan

(57) ABSTRACT

An exhaust manifold for a combustion engine which includes a flow deflector member to redirect the flow of exhaust through the catalytic converter in the exhaust system. The deflector member is in the shape of a ring conforming to the inner diameter of the manifold for secure mounting therein. The deflector ring has a center opening and an inwardly angled deflector wall which directs flow through the opening. Exhaust flow along the walls of the manifold is redirected inwardly by the deflector ring to optimize flow distribution through the exhaust system.

12 Claims, 2 Drawing Sheets

FLOW DEFLECTOR MEMBER FOR EXHAUST MANIFOLD

BACKGROUND OF THE INVENTION

I. Field of the Invention

This invention relates to control of combustion gases through an exhaust manifold and, in particular, to a deflector member mounted at an outlet of the exhaust manifold to optimize exhaust flow through the exhaust system particularly the catalytic converter.

II. Description of the Prior Art

As restrictions on exhaust emissions and fuel economy in passenger vehicles have increased, and market demands for passenger comfort have increased, vehicle manufacturers must continuously seek design improvements. These improvements are implemented within the engine compartment as well as the passenger compartment. Improved emission control devices are being added within the exhaust system. At the same time, manufacturers must fit these devices within an increasingly cramped space in order to maintain the roominess of the passenger compartment. As a result, exhaust manifolds are designed to strict tolerances to direct combustion gases from the exhaust ports of the engine through a collector to the remainder of the exhaust system.

As part of the emission control system of modern vehicles a catalytic converter has been inserted at the outlet of the exhaust manifold to reduce emissions prior to the main catalytic converter. It has been determined that the compact design of modern exhaust manifolds tends to direct a significant volume of the exhaust towards the outside of manifold bends. This proportion of the exhaust gas will affect the emission control materials within the converter.

SUMMARY OF THE PRESENT INVENTION

The present invention overcomes the disadvantages of the prior known exhaust manifolds by providing a deflector member positioned within the collector chamber of the manifold to optimize exhaust flow from the manifold.

The present invention embodies a deflector member positioned proximate the outlet of an engine exhaust manifold. The deflector is in the form of a ring having a center port such that exhaust flow is directed away from the outer walls of the manifold and toward the center of the catalytic converter.

The exhaust manifold includes a plurality of arms corresponding to the number of exhaust chambers of the engine. The arms are connected to the exhaust ports to provide fluid communication between the engine and the exhaust system. The exhaust arms are in communication with a collector chamber having an outlet port connected to the remainder of the exhaust system. Proximate the outlet of the exhaust manifold is a catalytic converter or similar emission control device which provides a first stage of emission control. However, because of the proximity of the emission control device to the outlet of the exhaust manifold, the flow distribution of the exhaust gases through the converter must be optimized to prevent premature erosion of some sections of the converter while also enhancing the overall performance of the converter.

In order to distribute exhaust flow, a deflector member is positioned at the outlet of the manifold. In a preferred embodiment, the deflector is a ring conforming to the configuration of the manifold walls with a central opening through which the exhaust is directed. The body of the ring includes an outer wall of securing the deflector member to the manifold and an inwardly angled wall for directing exhaust flow away from the manifold walls through the deflector ring. The deflector for redirecting the gas flow improves utilization of the catalytic converter brick while also reducing wear of the catalytic material by reducing convergence of the exhaust gases.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
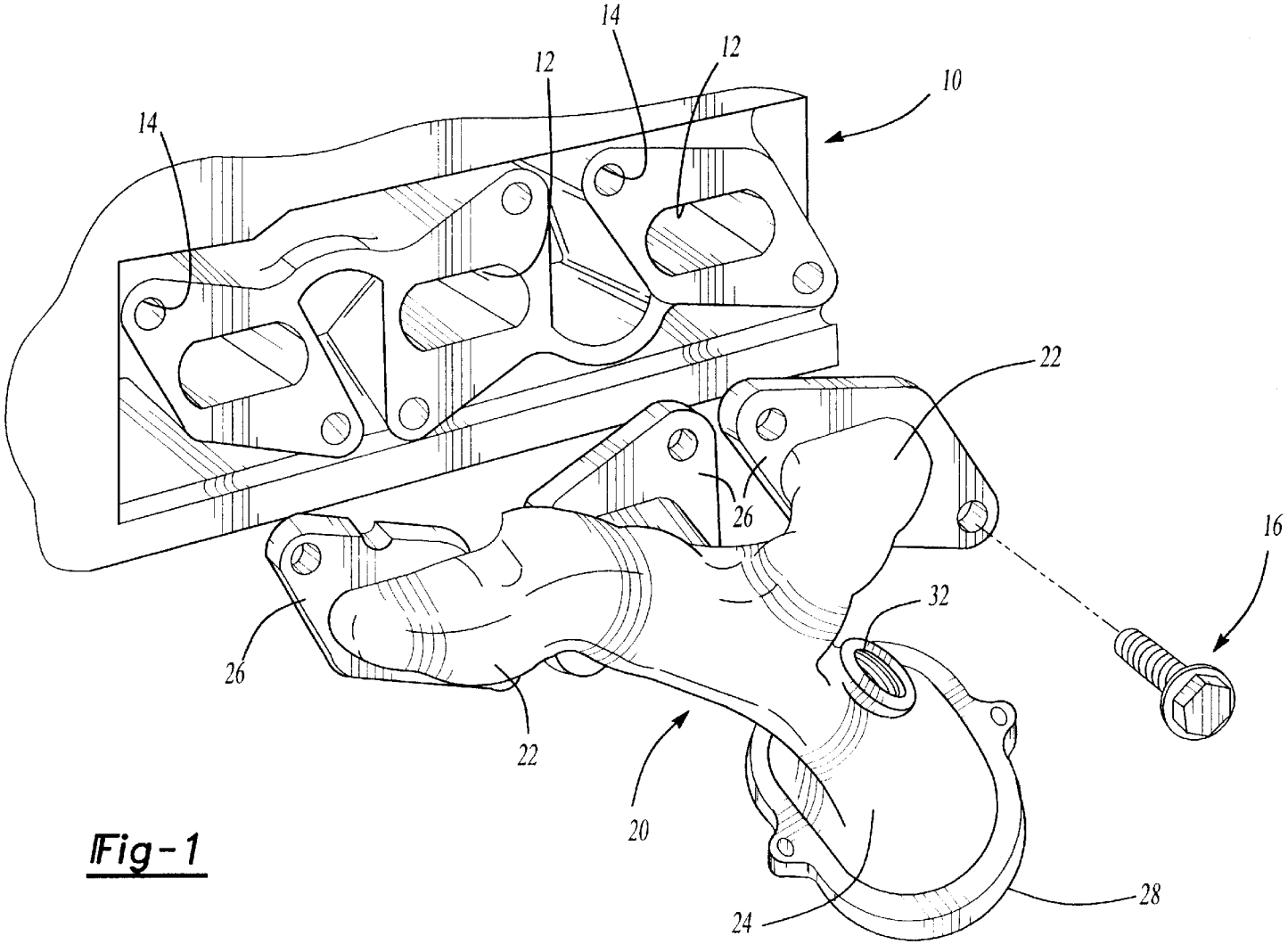
FIG. 1 is a perspective view of an exhaust manifold embodying the present invention.

Referring first to FIG. 1, there is shown a portion of an engine cylinder head 10 to which is secured an exhaust manifold 20 embodying the present invention. The engine 10 will include a plurality of exhaust ports 12 corresponding to the number of piston cylinders of the engine. The exhaust ports 12 may be disposed on opposite sides of the engine 10 requiring dual exhaust manifolds 20. The engine 10 includes threaded bores 14 proximate the exhaust ports 12 for receiving corresponding fasteners 16 to sealingly secure the exhaust manifold 20 in fluid communication with the exhaust ports 12. The exhaust manifold 20 is designed to collect exhaust gases from the engine 10 and efficiently direct the exhaust through the emission control devices of the exhaust system (not shown).

The manifold 20 typically includes a plurality of arms 22 corresponding to the exhaust ports 12 and a main body or collector chamber 24 in communication with the arms 22. The arms 22 and collector chamber 24 are configured to facilitate the smooth flow of exhaust gases to the exhaust system without creating disruptive turbulence or backflow of gases. The arms 22 include mounting flanges 26 for receiving the fasteners 16 to secure the manifold 20 to the engine 10. Remote from the inlet arms 22 is an outlet 28 of the collector chamber 24 which is connected to the remainder of the exhaust system. The manifold 20 may include additional ports 32 for mounting monitoring devices such as emission sensors.

Figure 2:
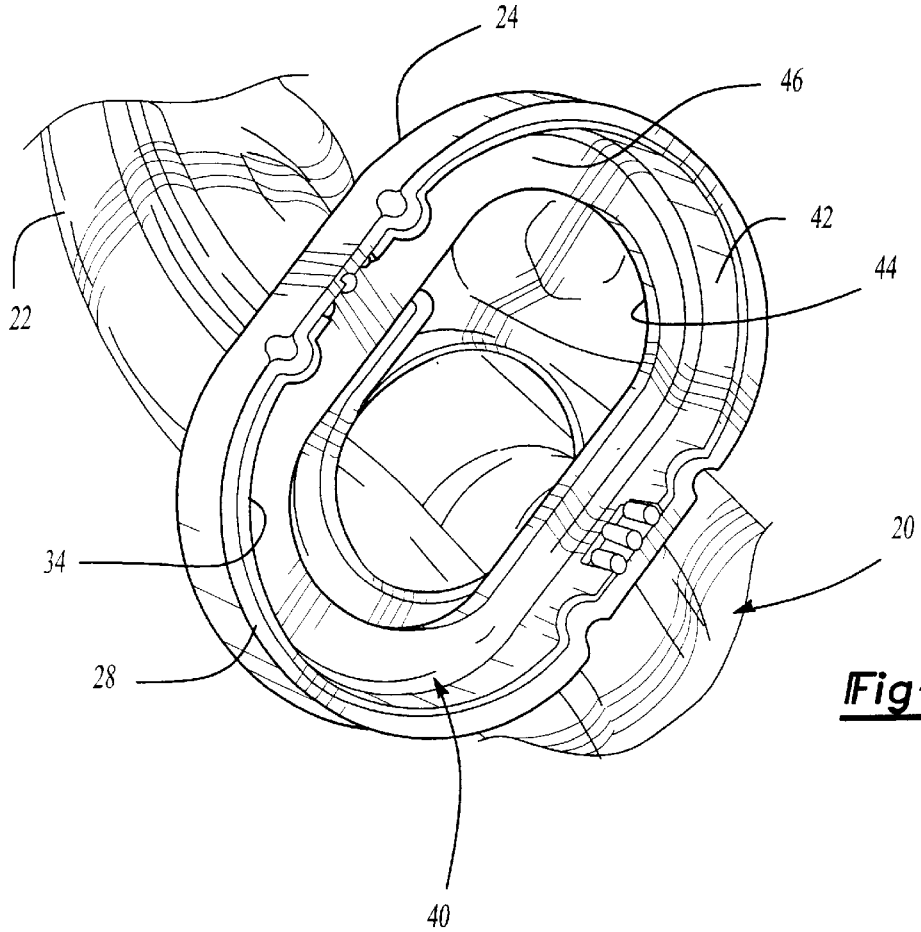
FIG. 2 is an end view of the exhaust manifold showing a flow deflector member mounted within the outlet.
Figure 3:
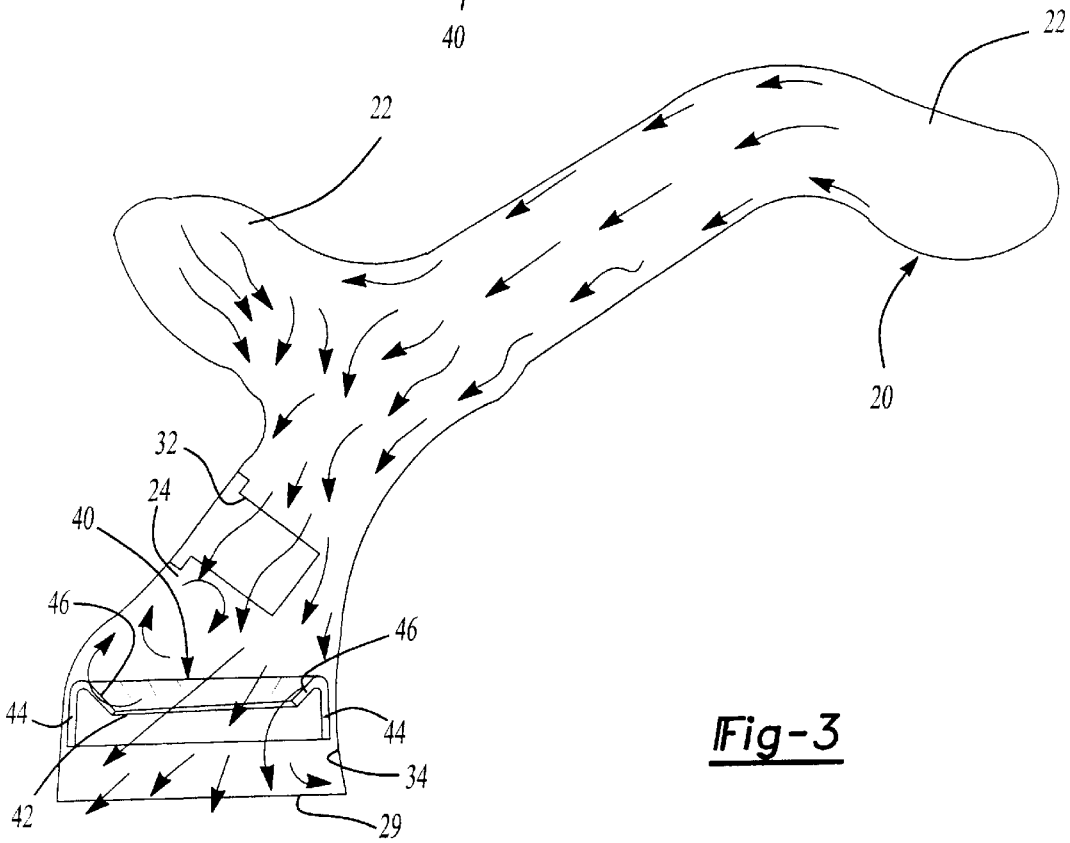
FIG. 3 is a schematic view of the manifold depicting the exhaust flow therethrough.

Referring now to FIGS. 2 and 3, secured within the outlet 28 of the manifold 20 is a flow deflector member 40 for optimizing the flow of exhaust gases from the manifold 20 across an emission control device (not shown) connected to the manifold 20. The deflector 40 is secured to the interior peripheral wall 34 of the manifold collector chamber 24 and therefore conforms to the configuration of the chamber 24. The deflector 40 is ring shaped with an inner opening 42 through which emission gases can flow (FIG. 3). The deflector member 40 has an outer wall 44 conforming to the inner periphery 34 of the chamber 24. The outer wall 44 is staked and welded or otherwise secured to the wall 34 of the manifold 20. Disposed radially inwardly from the outer wall 44 is a deflector wall 46. The deflector wall 46 is preferably angled inwardly and towards the downstream side of the deflector member 40.

The angle of the deflector wall 46 will cause the exhaust gas to flow away from the outer walls 34 of the manifold 20 through the opening 42 for a more even distribution across the emission control device. In the conventional manifold, the exhaust flow will tend to follow the outside curvature of the manifold wall concentrating the exhaust over a portion of the emission control device. The deflector ring 40 of the present invention provides a convenient and economical means of optimizing the flow of exhaust through the emission control device.

The foregoing detailed description has been given for clearness of understanding only and no unnecessary limitations should be understood therefrom as some modifications will be obvious to those skilled in the art without departing from the spirit and scope of the appended claims.

What is claimed is:

1. In an exhaust manifold for a combustion engine, the manifold having a collector chamber with an inner surface defining a flow path and an outlet in direct communication with an emission control device, the improvement comprising:

a flow deflector ring disposed within the flow path of the collector chamber of the manifold for dispersing the flow of exhaust flowing along said flow path through said outlet into the emission control device, said deflector ring including an annular deflector wall angled inwardly from an upstream end of said ring to direct fluid flow through a central opening of said deflector ring.

2. The manifold as defined in claim 1 wherein said flow deflector member is mounted proximate said outlet of said collector chamber for redirecting exhaust flow leaving said manifold.

3. The manifold as defined in claim 1 wherein said flow deflector member forms a ring having a central opening and substantially conforming to a wall of said collector chamber.

4. The manifold as defined in claim 3 wherein said flow deflector member has an outer wall conforming to an inner surface of said collector chamber such that said outer wall of said deflector member is in flush engagement with said inner surface of said collector.

5. An exhaust manifold for directing exhaust gases from a combustion engine, said manifold comprising:

a manifold body having a plurality of arms for connection to the engine and a collector chamber, said arms in fluid communication with said collector chamber and said collector chamber forming a flow path for the gases and having an outlet adapted to communicate with an emission control device; and a flow deflector ring mounted within said flow path of said collector chamber at said chamber outlet for redirecting the flow of exhaust gases exiting said collector chamber to disperse the exhaust flowing into the emission control device, said deflector ring having an outer wall engaging a wall of said chamber and an inwardly angled annular deflector wall for dispersing the flow of exhaust gases passing through a central opening of said deflector ring.

6. The manifold as defined in claim 5 wherein said deflector ring includes an outer wall integrally formed with said deflector wall, said outer wall conforming to a configuration of an inner surface of said collector chamber.

7. The manifold as defined in claim 6 wherein said outer wall of said deflector ring is secured to said inner surface of said collector chamber to mount said deflector ring within said manifold proximate said outlet of said collector chamber whereby fluid flow within said collector chamber is directed inwardly through said central opening of said deflector ring.

8. An exhaust manifold for directing exhaust gases from a combustion chamber, said manifold comprising:

a manifold body having a plurality of arms and a collector chamber with an inner surface, said arms in fluid communication with said collector chamber and said collector chamber forming a flow path having an outlet adapted to communicate with an emission control device; and a flow deflector member disposed within said flow path of said collector chamber for redirecting the flow of exhaust gases from along the wall of said collector chamber to disperse the exhaust flow as it exits said manifold body into the emission control device, said deflector member mounted proximate said outlet of said collector chamber and forming a ring substantially conforming to said wall of said collector chamber, said deflector member having an outer wall conforming to said inner surface of said collector chamber such that said outer wall is in flush engagement with said inner surface of said collector chamber.

9. The manifold as defined in claim 8 wherein said outer wall of said deflector member is attached to said chamber inner surface.

10. The manifold as defined in claim 1 wherein said deflector member includes a deflector wall disposed radially inwardly of said outer wall and extending from an upstream end of said outer wall.

11. The manifold as defined in claim 10 wherein said deflector wall is angled radially inwardly to direct exhaust flow through said central opening of said deflector ring.

12. The manifold as defined in claim 10 wherein said deflector wall is integrally formed with said outer wall to form a single piece deflector ring.

* * * * *